United States Patent [19]

Martin et al.

[11] Patent Number: 4,915,282

[45] Date of Patent: Apr. 10, 1990

[54] INERTIA COMPENSATED FESTOON ASSEMBLY

[75] Inventors: John R. Martin, Rockford; Roger Cederholm, Loves Park; Larry E. Curtin, Rockford, all of Ill.

[73] Assignee: Martin Automatic, Inc., Rockford, Ill.

[21] Appl. No.: 302,475

[22] Filed: Jan. 26, 1989

[51] Int. Cl.[4] ..... B65H 23/18; B65H 23/182; B65H 23/188

[52] U.S. Cl. ..... 226/119; 226/44

[58] Field of Search ..... 226/44, 117, 118, 119; 242/195, 25

[56] References Cited

U.S. PATENT DOCUMENTS

| | | | |
|---|---|---|---|
| 3,659,767 | 5/1972 | Martin | 226/195 |
| 3,905,533 | 9/1975 | Corse | 226/44 |
| 4,011,976 | 3/1977 | Greer | 226/117 X |
| 4,360,137 | 11/1982 | Noe et al. | 226/119 X |
| 4,771,621 | 9/1988 | Sato | 226/119 X |

FOREIGN PATENT DOCUMENTS

| | | | |
|---|---|---|---|
| 0118645 | 7/1984 | Japan | 226/44 |

*Primary Examiner*—Donald Watkins

*Attorney, Agent, or Firm*—McAndrews, Held & Malloy, Ltd.

[57] ABSTRACT

An inertia compensated festoon assembly useable to control the tension in a moving web that is subject to tension changes due to, among other things, frequent zero-speed splices of the web to a new web and that must run continuously, downstream from the assembly, at relatively high speed and under relatively constant, relatively low tensions. The assembly includes a first, inertia compensated multiple floating dancer roller festoon, in series with an isolation driven roller, and a second, inertia compensated single floating dancer roller festoon.

5 Claims, 1 Drawing Sheet

INERTIA COMPENSATED FESTOON ASSEMBLY

BACKGROUND OF THE INVENTION

The present invention relates to festoon assemblies of the type used with web processing equipment, and more particularly, to inertia compensated festoon assemblies usable to control precisely the tension in a web that is subject to tension changes and that is moving at a relatively high speed to and through web processing equipment.

Inertia compensated festoons are known and recognized in the art as excellent means for preventing fluctuations in tension in one region of a moving web from causing tension changes in another, downstream region of the web. As explained in U.S. Pat. No. 3,659,767 issued to John R. Martin, one of the inventors of the present invention, such inertia compensated festoons include a single inertia compensated "floating", "dancer" roller or multiple inertia compensated floating, dancer rollers. Following the teaching of U.S. Pat. No. 3,659,767, the assignee of the present application has for many years included either single or multiple floating dancer roller inertia compensated festoons as an integral part of its web butt splicers, and other similar high speed web handling equipment that are sold for use with web processing equipment. These festoons have admirably performed their intended function. More specifically, they have accurately controlled the tension in the moving web and have, for example, provided the web storage needed to permit a zero-speed butt splice to be made while the downstream portion of the web on the expiring roll continues to be fed, at normal speed, to the continuous web processing equipment, as for example, a printing press.

In certain applications that require webs to be run at relatively high web speeds and under relatively low tensions so as to avoid permanently deforming the webs during operation, it has been found that the heretofore available inertia compensated festoons are not completely suitable. For instance, recently it has been proposed to run the fragile, low modulus of elasticity webs used to make disposable diapers at the relatively much higher speeds of eight hundred to one thousand feet per minute (instead of around six hundred feet per minute). These operating speeds require that a multiple dancer roller festoon be utilized. Otherwise the assembly would not have sufficient web storage capacity so as to enable the web to continue running, at such relatively high speeds, to and through the disposable diaper making line during the frequent zero-speed splices. However, at these relatively high speeds and with these low modulus of elasticity webs, it has been found that the prior multiple dancer roller inertia compensated festoons do not always provide accurate enough tension control. The reason for this, it is believed, is that the web stretches in the web spans between the multiple rollers in the festoon. This stretch was not contemplated in the discussions in U.S. Pat. No. 3,659,767. As a result, not all of the tension variations or fluctuations in the web are removed.

SUMMARY OF THE INVENTION

In principal aspect, the present invention relates to an improved festoon assembly that permits readily permanently deformable webs to be run at relatively high speeds and under relatively constant, relatively low tensions to and through web processing equipment even while a zero-speed splice is being made upstream of the festoon assembly. More particularly, our improved festoon assembly is capable of being utilized with low modulus of elasticity webs (such as those used to make disposable diapers) that must be frequently spliced at zero-speed and that are continuously run downstream from the splice at relatively high speeds (as for example, at eight hundred to one thousand feet per minute) and under relatively constant, relatively low tension (as for example, under one half to one pound total tension on a twenty inch wide web or at approximately 0.025 pound per linear inch, with this total tension being held within plus or minus one-quarter pound or less) to and through web processing equipment (as for example, a disposable diaper manufacturing line).

Accordingly, an object of the present invention is to provide an improved inertia compensated festoon assembly wherein a multiple floating dancer roller inertia compensated festoon is employed in series with an isolation driven roller and then with a single floating dancer roller inertia compensated festoon, wherein the multiple dancer roller inertia compensated festoon provides the web storage capacity needed during zero-speed splices and "coarse" tension control, and wherein the isolation driven roller and the single dancer roller inertia compensated festoon provide the "fine" tension control and prevents the "hunting" or oscillating of the dancer rollers in the two festoons. A related object of the present invention is to provide an improved inertia compensated festoon assembly, as described, wherein the web is driven by the isolation driven roller at speed directly related to the position of the dancer roller in the second inertia compensated festoon, vis-a-vis a first preselected fixed position or point, and the speed of web downstream of the festoon assembly. Another related object of the present invention is to provide an improved inertia compensated festoon assembly, as described, wherein the web is driven upstream from the festoon assembly at a speed directly related to the position of the multiple dancer rollers in the first inertia compensated festoon, with respect to a second preselected fixed position or point, and the speed of the web downstream from the festoon assembly. Still another related object of the present invention is to provide an improved inertia compensated festoon assembly, as described, that can reliably perform its intended function even when the speed of the web necessitates frequent zero-speed splices of the web, that can be relatively inexpensively manufactured, and that does not require an inordinately large amount of floor space.

A still further object of the present invention is to provide an improved method of running a web at relatively high speeds and under relatively constant, relatively low tensions to and through web processing equipment while the web upstream is being spliced at zero-speed, wherein the web is initially run through a multiple dancer roller inertia compensated festoon, then driven by an isolation driven roller, and then lastly run through a single dancer roller inertia compensated festoon. A related object of the present invention is to provide the improved method, as described, where the web is driven, upstream of the festoon, at a speed directly related to the position of the multiple dancer rollers in the first inertia compensated festoon assembly, vis-a-vis a preselected position, and the speed of the web downstream of the festoon assembly. Another related object of the present invention is to provide the improved method, as described, where the isolation driven roller is driven at speed directly related to the position of the dancer roller in the second inertia compensated festoon, vis-a-vis a preselected position, and the speed of the web downstream of the festoon assembly.

These and still other objects, advantages and aspects of the present invention are more fully set forth in the following description of the preferred embodiment of the present invention.

DESCRIPTION OF THE DRAWINGS

In the detailed description of the invention that follows, reference will be made to the accompanying drawing comprised of.

DETAILED DESCRIPTION OF THE PREFERRED EMBODIMENT

Figure 1:
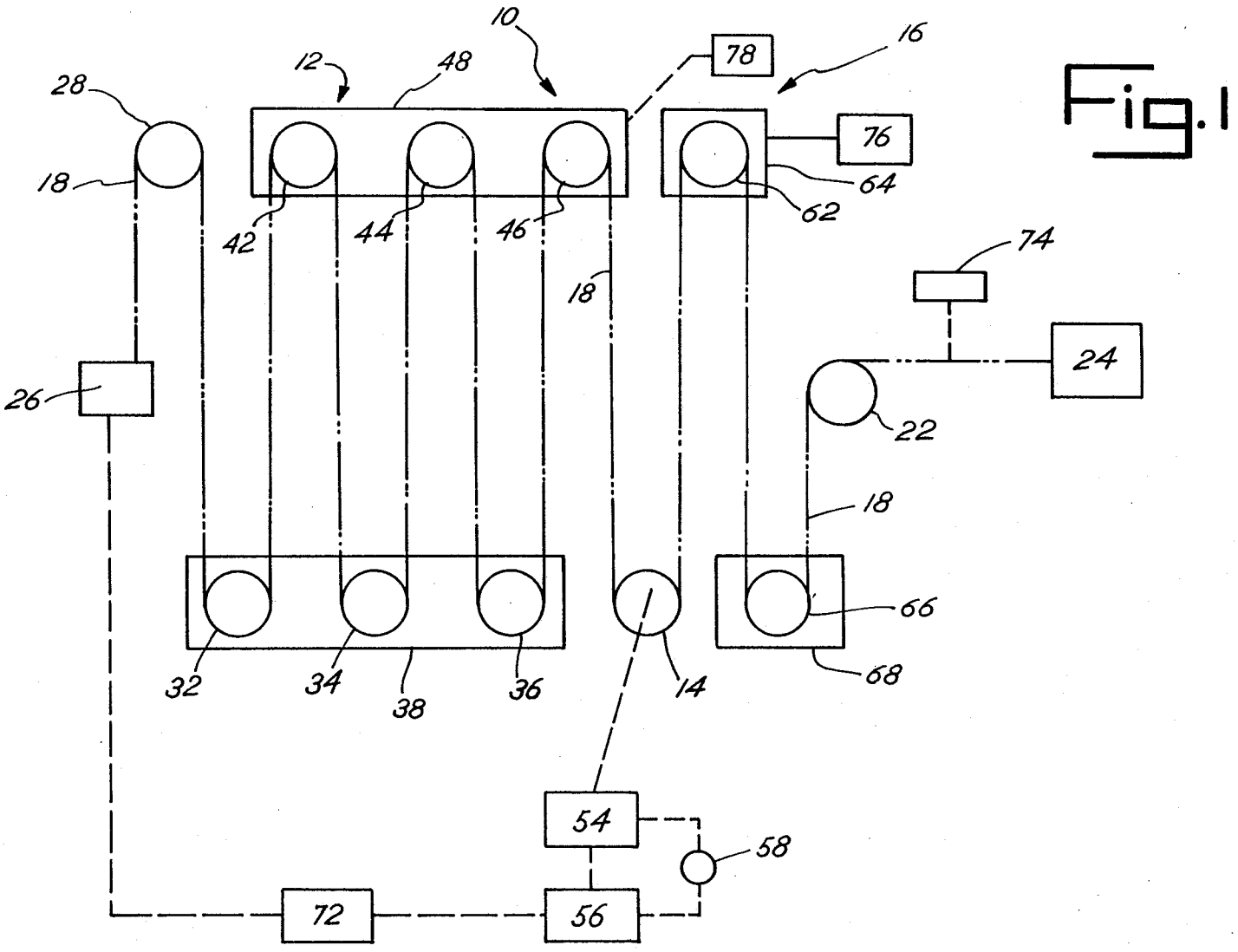
FIG. 1 is a schematic illustration of a web handling system that includes the improved inertia compensated festoon assembly of the present invention.

Referring now to FIG. 1, the improved inertia compensated festoon assembly of the present invention is shown generally at 10. This assembly includes a first, multiple dancer roller inertia compensated festoon 12, an isolation driven roller 14, and a second, single dancer roller inertia compensated festoon 16. Each of these components will be described with more specificity below.

The web 18 runs through the festoon assembly 10 as described below. After exiting from the assembly 10, the web passes about a conventional idler roller assembly 22 and runs to and through web processing equipment 24 that may, for example, be a disposable diaper manufacturing line.

Before entering the festoon assembly 10, the web 18 runs off of an unwinding web roll 26 and around a conventional idler roller assembly 28. The web roll 26 may be mounted on a web roll stand such as described in co-pending U.S. patent application Ser. No. 193,290, filed May 5, 1988, which application is incorporated herein by reference thereto. The spindles on the roll stand are preferably driven as described in co-pending U.S. patent application Ser. No. 07/302,569, filed on January 26, 1989, which application is incorporated herein by reference thereto. The web 18 may also pass through and be associated with a zero-speed butt splicer such as that described in co-pending U.S. patent application Ser. No. 153,578, filed Jan. 29, 1988, which application is also incorporated herein by reference thereto.

The festoon 12 includes a plurality of fixed idler rollers 32, 34 and 36 that are free to rotate about their axes on a support 38. This festoon also includes a plurality of floating, dancer rollers 42, 44 and 46 that are mounted for rotation about their axes on a floating carriage 48. The web 18 passes alternatively around the fixed rollers 32, 34 and 36 and the dancer rollers 42, 44 and 46. It exits from the festoon 12 after it passes around the dancer roller 46. The position of the carriage 48, vis-a-vis the idler rollers 32, 34 and 36, determines the tension on the web 18 as it passes through the festoon 12.

The web 18 then passes about the isolation driven roller 14 that is mounted for rotation on a support, not shown, that may form a part of the support 38. The tension of the web 18 around the driven roller 14 is sufficient so that there is no need for a nip roller. The omission of a nip roller, of course, makes the assembly simpler and more reliable as well as easier and safer to thread up.

The isolated driven roller 14 is driven by a conventional D.C. motor 54 and a conventional regenerative controller, also known as regenerative adjustable, variable speed drive or four-quadrant drive, generally shown at 56. The motor 54 may be a one-quarter horsepower Model N. CDP3310 motor marketed by the Baldor Electric Co. of Fort Smith, Ark. The controller 56 may be a Model No. 540 controller marketed by Shackleton System Drives Corporation of Reston, Va. A sensor 58 may be used with the motor 54 to feedback a signal to the controller 56 indicative of the speed that motor is running. Such a sensor 58 may be a tach generator Model No. BTG 1000 marketed by Baldor Electric Co. of Fort Smith, Ark.

After passing around isolation driven roller 14, the web 18 next enters the festoon 16. It includes a single floating dancer roller 62 that is mounted for rotation about its axis on a floating carriage 64. The festoon 26 also includes a fixed idler roller 66 that is free to rotate about its axis on a support 68. The web 18 passes around the dancer roller 62 and the fixed roller 66 and then exits from the festoon. As noted above, the web 18 then passes around idler assembly 22 and to the web processing equipment 24.

The festoon 16, like the festoon 12, functions in accordance with the teachings of U.S. Pat. No. 3,659,767. The festoons may be structurally identical to those inertia compensated festoons provided as a component of the Martin Model MBLT Zero-Speed Butt Splicer marketed by Martin Automatic, Inc. of Rockford, Ill. To achieve the desired results, each of the festoons 12 and 16 should be engineered and constructed so a position change of the moving dancer rollers does not add any changing forces to the festoon and so the inertia (mass) of the dancer rollers and moving support structure (that is, the cables, pulley wheels, carriage loading or support cylinders, etc.) is minimized. Additionally friction forces should be minimized in the cables, pulley wheels and loading cylinders of the festoons. In other words, friction in the festoons should be minimized so as to eliminate, to the extent possible, load changes, as sensed by the web, in the festoons due to, for example, pressure changes in the loading cylinder and friction resulting from contact between moving dancer roller carriages and the sensor that senses the position of the carriages. This may be achieved, for example, by using labyrinth seals in the carriage loading cylinder so that there is no physical contact between the piston, rod and cylinder walls and by the use of position sensors, as described below, that do not require physical contact between the carriages and a fixed member. Additionally, all web leads in the festoons should be vertical. Otherwise the tension in the web will change when the dancer rollers or roller go up and down. Further and through the design of the carriage support structure, including the loading cylinders, the setting of a tension level of the web 18 in the festoon 12 should result in an identical tension level setting for the web 18 in festoon 16.

The operation of the motor 54 may be controlled by a conventional programmable logic controller ("PLC") shown generally at 72. This PLC 72 may be the Model No. 5-15 marketed by the Allen-Bradley Co. of Milwaukee, Wis. More specifically, the PLC 72 operates the motor 54, through the controller 56, and the motor 54 drives the isolation driven roller 14 in a conventional manner. This operation of the PLC 72 is based on information signals inputted or received from a conventional web speed sensor 74 that senses the speed of the web 18 downstream from the festoon assembly 10 and from a conventional "position" sensor 76 that senses the position of the dancer roller carriage 64 with respect to a preselected fixed position that relates to the tension imposed on the web 18.

The sensor 74 is not in physical contact with the web 18. The sensor 74 may be a tach generator Model No. BTG 1000 marketed by Baldor Electric Co. of Fort Smith, Ark. The position sensor 76 is carried by the carriage 64, and does not come into physical contact with any other fixed member. The sensor 76 may be the Model No. RS-120H-1-SA marketed by Sunx Trading Co. Ltd. of Tokyo, Japan. The sensors 74 and 76 are connected with the PLC 72 in a conventional manner.

The PLC 72 may also be used to control the speed of the web 18 downstream of the festoon assembly 10. As more specifically described in U.S. application Ser. No. 07/302,569, filed on Jan. 26, 1989, a D.C. motor and a four quadrant controller, similar to the motor 54 and controller 56, may be associated with the web roll 26 and may be used to drive the spindle on which the web roll 26 is driven at a speed that is directly related to the speed of the web downstream from the festoon assembly, as sensed by the sensor 74, and the position of the movable dancer roller carriage 48 of the festoon 12, vis-a-vis a preselected position that relates to the tension imposed on the web 18. The position of the carriage 48 is sensed by the conventional position sensor 78 that may be the same as the sensor 76. Similar to the sensor 76, the sensor 78 is mounted on the carriage 48 so that there is no physical contact between it and any other fixed member. The sensor 76 is also connected with the PLC 72 in a conventional manner.

The logic or ladder commands that may be programmed in the PLC 72 are as described in U.S. patent application Ser. No. 07/302,569, filed on Jan. 26, 1989. It should be noted, however, that this program also permits the PLC, as described in the co-pending application, to control the zero-speed butt splicing of the web.

During the normal running of the web 18, the PLC 72 receives a signal from the sensor 78 as to the position of the dancer roll carriage 48, from the sensor 76 as to the position of the carriage 64, and from the sensor 74 as to the speed of the web downstream from the assembly 10. Based on these signals, the PLC 72 controls the speed of the isolation driven roller 14 through the motor 54 and controller 56 and the speed of the spindle for the web roll 26. By controlling the speed of the isolation driven roller and the web roll spindle, the speed of the web can be controlled so as to return the dancer roller carriages 48 and 64 to their preselected positions.

The preferred embodiment of the present invention has now been described. This preferred embodiment constitutes the best mode contemplated by the inventors for carrying out their invention. Because their invention may be copied without copying the precise details of the preferred embodiment, the following claims particularly point out and distinctly claim the subject matter which the inventors regard as their invention and wish to protect.

We claim:

1. An improved inertia compensated festoon assembly usable for controlling the tension in a moving web that is run downstream from the improved festoon assembly at a relatively high speed and under relatively constant, relatively low tension to and through web processing means and that is subject to abrupt tension changes upstream from the improved festoon assembly, the improved festoon assembly comprising:

a first, inertia compensated festoon having multiple floating dance rollers and multiple fixed idler rollers, with the moving web being adapted to pass alternatively about the idler rollers and the dancer rollers of the first inertia compensated festoon, with the first, inertia compensated festoon providing the web storage capacity needed during the abrupt web tension changes upstream from the festoon assembly and course tension control for the moving web;

an isolation driven roller disposed in the path of the moving web downstream from the first festoon and adapted to drive the moving web as the moving web passes about the isolation driven roller;

a second, inertia compensated festoon disposed in the path of the moving web downstream from the isolation driven roller and having a floating dancer roller and an idler roller, the moving web being adapted to pass alternatively about the dancer and idler rollers of the second inertia compensated festoon, with the second inertia compensated festoon and the isolation driven roller providing fine tension control of the moving web and preventing the hunting of the dancer rollers in the first and second inertia compensated festoons;

means for sensing the speed of the moving web downstream from the second inertia compensated festoon;

means for sensing the position of the dancer rollers of the first inertia compensated festoon with respect to a first preselected position;

means for sensing the position of the dancer roll in the second inertia compensated festoon with respect to a second preselected position;

means for driving the moving web upstream from the first inertia compensated festoon;

means for driving the isolation driven roller at a speed that relates to the speed of the moving web downstream of the second inertia compensated festoon, and the position of the dancer roller of the second inertia compensated festoon with respect to its second preselected position; and means for driving the web upstream from the first inertia compensated festoon at a speed that relates to the speed of the moving web downstream of the second inertia compensated festoon and the position of the dancer rollers of the first inertia compensated festoon with respect to their first preselected position.

2. The improved inertia compensated festoon assembly of claim 1 wherein the first inertia compensated festoon includes three dancer rollers.

3. The improved inertia compensated festoon assembly of claim 1 wherein the first inertia compensated festoon is disposed immediately adjacent to and upstream from the isolation driven roller; and wherein the isolation driven roller is, in turn, disposed immediately adjacent to and upstream from the second inertia compensated festoon.

4. The improved inertia compensated festoon assembly of claim 3 wherein the first inertia compensated festoon includes three dancer rollers.

5. An improved method for controlling tension in a moving web at a control point in the travel of the moving web that must be run downstream from the control point at a relatively high speed and under relatively constant, relatively low tension and that is subject to abrupt tension changes upstream from the control point; the improved method comprising the steps of:

running the moving web through a first set of inertia compensated floating dancer rollers and idler rollers so that the moving web passes alternatively about an idler roller and a floating dancer roller, and so as to provide the web storage capacity needed during the abrupt tension changes upstream from the first set of inertia compensated floating dancer rollers and idler rollers and coarse tension control for the moving web;

running the moving web, downstream from the first set of inertia compensated rollers, through a second set of an inertia compensated floating dancer roller and idler roller so that the moving web passes alternatively about the floating dancer roller and the idler roller;

driving the moving web at a point downstream of the first set of the inertia compensated rollers and upstream from the second set of inertia compensated rollers at a speed related to the speed of the moving web downstream from the second set of inertia compensated rollers and the position of the dancer roller in the second set of inertia compensated rollers with respect to a first preselected position so as, in combination with the second set of inertia compensated rollers, to provide fine tension control for the moving web and prevent the hunting of the dancer rollers in the first and second sets of inertia compensated rollers; and driving the moving web at a point upstream of the first set of inertia compensated rollers at speed related to the speed of the moving web downstream from the second set of inertia compensated rollers and the position of the dancer rollers in the first set of inertia compensated rollers with respect to a second preselected position.

* * * * *